United States Patent [19]

Woelfel

[11] Patent Number: 4,520,248

[45] Date of Patent: May 28, 1985

[54] KEYBOARD ASSEMBLY

[75] Inventor: Robert Woelfel, Palatine, Ill.

[73] Assignee: Rogers Corporation, Rogers, Conn.

[21] Appl. No.: 178,471

[22] Filed: Aug. 15, 1980

[51] Int. Cl.[3] ..... H01H 13/14

[52] U.S. Cl. ..... 200/340; 200/159 B

[58] Field of Search ..... 200/5 A, 159 B, 159 R, 200/159 A, 330, 340

[56] References Cited

U.S. PATENT DOCUMENTS

| | | | |
|---|---|---|---|
| 3,693,775 | 9/1972 | Brooks et al. | 200/159 B |
| 3,699,294 | 10/1972 | Sudduth | 200/159 B |
| 3,723,673 | 3/1973 | Clary et al. | 200/159 B |
| 4,258,096 | 3/1981 | LaMarche | 200/159 B |

*Primary Examiner*—John W. Shepperd

*Attorney, Agent, or Firm*—Fishman & Dionne

[57] ABSTRACT

An improved membrane keyboard is provided wherein the keys are spatially separated and formed from resilient foam. Specifically, this membrane keyboard provides the user with a sensation of movement to indicate key activation.

28 Claims, 4 Drawing Figures

KEYBOARD ASSEMBLY

BACKGROUND OF THE INVENTION (1) Field of the Invention

The present invention relates to the manufacture of membrane keyboard. Specifically, the present invention relates to a keyboard including spatially separated keys and having a construction which will simulate or give the effect of long travel (on the order of 0.100" or more) as compared to a short travel (about 0.003"–0.010") of a conventional membrane keyboard. Accordingly, the general objects of the present invention are to provide novel and improved methods and apparatus of such character.

(2) Description of the Prior Art

Early prior art flat membrane keyboards failed to provide a user with any indication that the key had been activated because of the very limited movement of the keys. This demonstrated the desirability of providing membrane keyboards with keys capable of providing the user with a sensation of movement to indicate key activation. More recent prior art membrane-type keyboards incorporating a snap-action element to provide sensation of movement through tactile feedback, have a flat flexible legend sheet defining the area which the user must depress to actuate the snap-action element associated with that particular area.

The disadvantages associated with this prior art are the additional expense of producing the circuit board with the snap-action element and the fact that the user must visually locate the key area on the flat flexible legend before the key is depressed. Further, in many devices, if the user depressed the key at a point removed from the center of the key, the electrical circuit contacts operated by the key may be closed without providing the sensation of movement or the key may provide the movement sensation without contact being made. The accuracy of the data entered by means of the keyboard accordingly, is a function of the operator's attentiveness.

The prior art discloses various methods of alleviating the above-mentioned problems associated with locating the keys visually on the flat flexible legend. One such method involves providing the flexible legend with indentations which are aligned with the snap-action elements of the circuit board. Because of these indentations the flexible sheet must be separated from the circuit board by a compressionable medium. While overcoming the above mentioned disadvantages associated with visually locating keys, this method requires additional expense in manufacturing the keyboard.

Some of the objects of the present invention are to provide an improved membrane keyboard wherein the keys may be located by a user nonvisually and also to provide the user with a sensation of movement.

SUMMARY OF THE INVENTION

The present invention overcomes the above-discussed disadvantages and other deficiencies of the prior art by providing an improved membrane keyboard assembly.

A membrane keyboard assembly in accordance with the present invention includes a laminate of a flat flexible legend sheet, a resilient foam material, and a bottom flexible sheet carrying printed circuitry. Individual keys are formed in this laminate by cutting through the flat flexible legend and the resilient foam material to within a short distance from the bottom flexible sheet. The thus prepared laminate may be used in conjunction with a conventional data processing apparatus by placing a second flexible sheet carrying printed circuitry under the laminate and separated from the laminate by a nonconductive spacer. Data is entered by exerting a compressive force on the keys to bring the printed circuitry of the laminate into contact with the printed circuitry of the second flexible sheet and thus complete an electric circuit.

The present invention provides numerous advantages over the prior art. Thus the travel of individual keys is permitted without effecting displacement of adjacent keys. Also to provide the user is provided with the sensation of key movement; and the keys may be nonvisually located. Further the present invention allows for the production of an inexpensive membrane keyboard.

BRIEF DESCRIPTION OF THE DRAWINGS

The present invention may be better understood and its numerous objects and advantages will be apparent to those skilled in the art by reference to the accompanying drawings wherein like reference numerals refer to like elements in the several figures and in which.

DESCRIPTION OF THE PREFERRED EMBODIMENT

Figure 1:
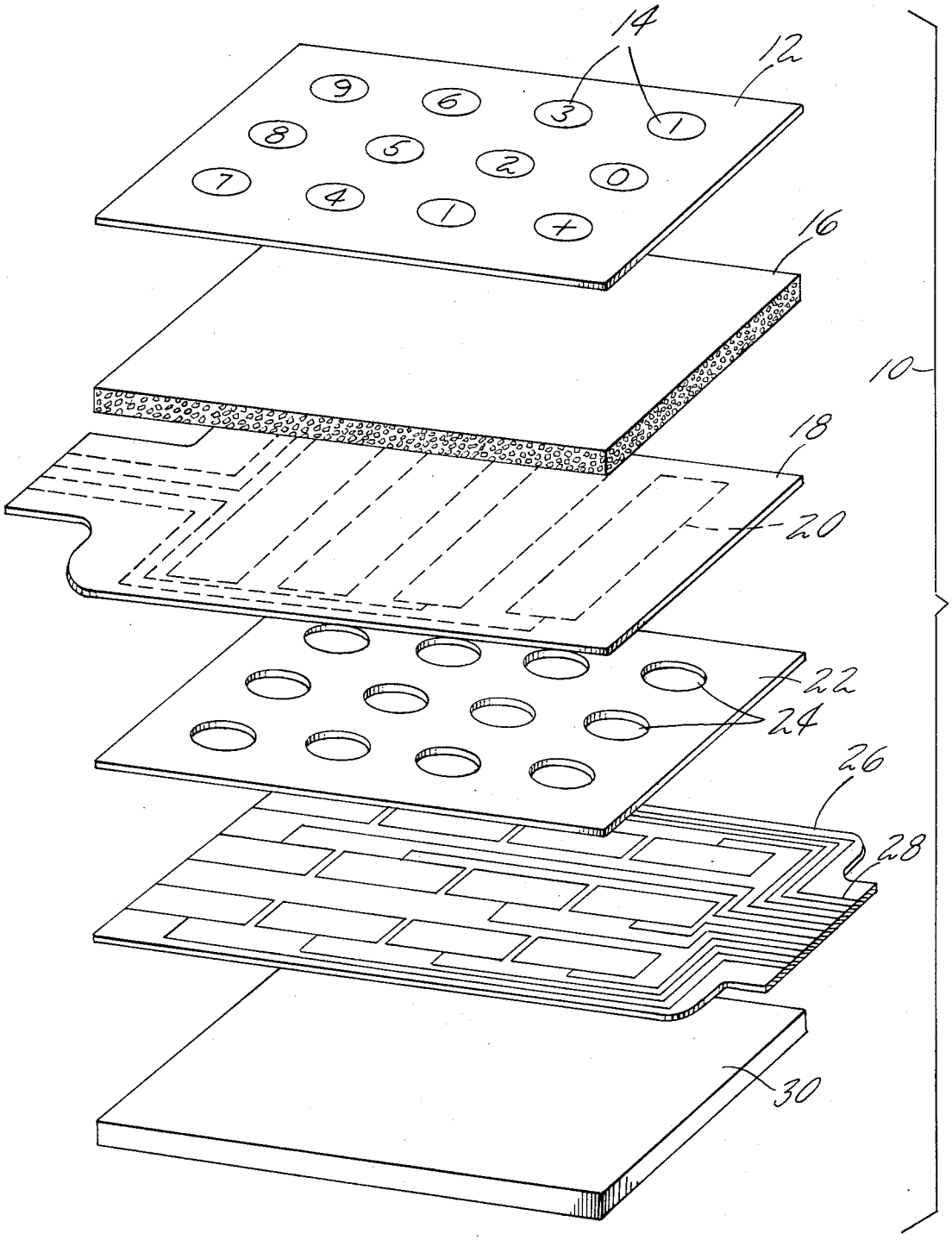
FIG. 1 is an exploded view of the components from which a membrane keyboard assembly including the present invention will be formed.

Referring to FIG. 1, the components from which a membrane keyboard assembly in accordance with the invention will be formed are indicated collectively and generally at 10. These components include a flat legend sheet 12, a resilient foam layer 16, a first flexible printed circuit board or substrate 18, spacer sheet 22, a second flexible printed circuit board or substrate 26 and a backing board 30. These individual components of a keyboard assembly may be adhered to each other by any conventional adhesive.

The circuit boards 18 and 26 are usually comprised of a flexible plastic material such as the polyethylene terphthalate known as "Mylar". The circuit boards 18 and 26 define substrates for conductive patterns 20 and 28, respectively. Conductive patterns 20 and 28 are formed from copper, conductive ink or other conductive material by conventional printed circuit techniques.

Spacer sheet 22 and legend sheet 12 are of a nonconductive material, also typically "Mylar". Spacer sheet 22 is provided with die-cut apertures 24, which may be of any desired shape, and legend sheet 12 is provided with a design 14. The resilient foam sheet 16 is preferrably made from a foam material of the type characterized by a low compression set. By low compression set, it is meant that after repeated compression and expansion, the material essentially maintains its dimension. An example of such a material is PORON foam obtainable from Rogers Corporation, the assignee of this invention.

Figure 2:
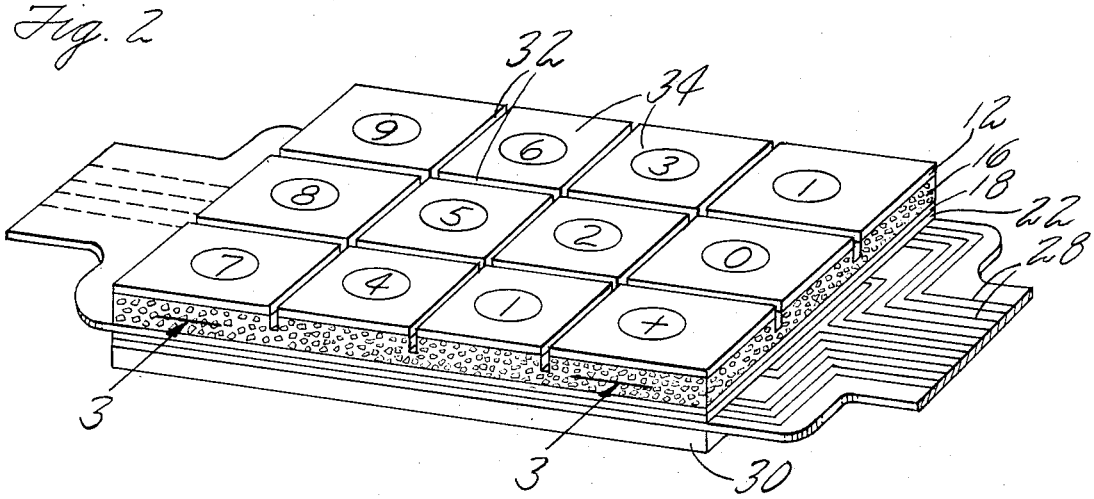
FIG. 2 is a perspective view of a portion of a membrane keyboard assembly incorporating a preferred embodiment of the present invention.

Referring now to FIG. 2 a keyboard assembly is shown in its final form. Legend sheet 12 and resilient foam sheet 16 have been provided with cuts 32 in a crosswise pattern. Thse cuts define twelve individual key areas 34. The cuts 32 have a general width of 0.060" to 0.250" and have a depth of about 0.050" so as to terminate approximately 0.250" short of the first printed circuit board 18. These cuts may be produced by any conventional method, such as by using a heated blade or laser beam. In the preferred embodiment of this invention the legend sheet 12, resilient foam sheet 16 and first printed circuit board 18 are adhered to each other by any conventional adhesive before cuts 32 are made. In another method of manufacturing the present invention the foam sheet 16 is first cut and then individual pieces of legend sheet 12 are adhered to it.

Figure 3:
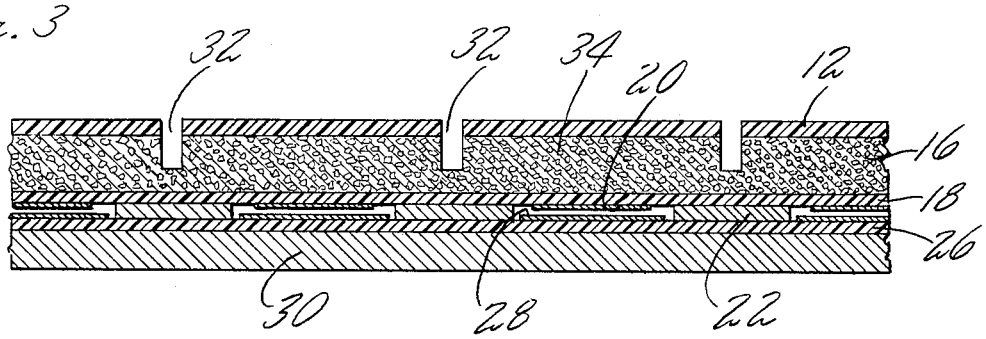
FIG. 3 is a cross-sectional side-elevation view taken along line 3—3 of FIG. 2.

FIG. 3 shows a cross-sectional view of the keyboard assembly of FIG. 2 and demonstrates the structure of the individual keys 34 formed by cuts 32. The user of the keyboard assembly, by depressing a key 34, will urge a contact region of the conductive pattern 20 on printed circuit board 18, which is associated with that particular key 34, through an aperture 24 in spacer 22 so that the contact on board 18 makes electrical contact with a contact of the conductive pattern 28 on the second printed circuit board 26 which is in registration therewith to complete an electrical circuit. Nonconductive spacer sheet 22 normally prevents electrical contact between the conductors on circuit boards 20 and 26. By using a low compression set foam the individual keys 34 maintain their dimensions and thus do not deform in such a manner so as to allow the conductive patterns 20 and 28 to come into contact with each other without first the compression of a key.

Figure 4:
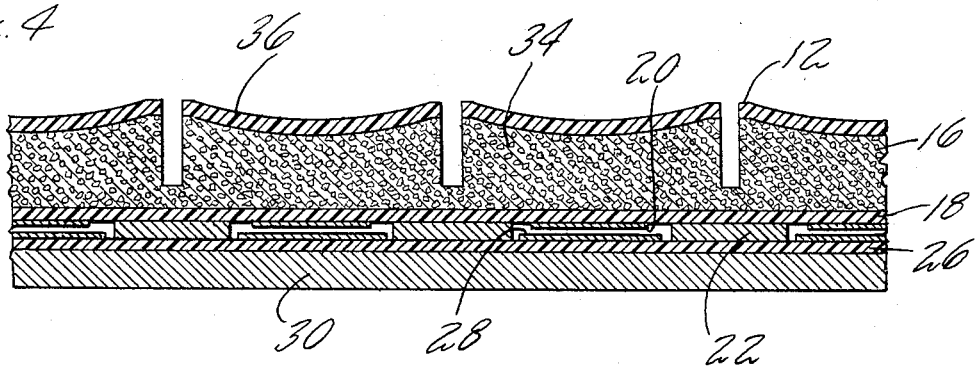
FIG. 4 is a cross-sectional side-elevation view of another embodiment of the present invention.

Finally, referring to FIG. 4, another embodiment of the present invention is shown. The keyboard of FIG. 4 includes the same components with the only difference in this construction being cup-shaped depressions 36 which is in registration therewith. These depressions or indentations 36 may be provided by any known process. One such process involves subjecting the foam sheet 16 to a heated fixture (250° F. to 450° F.) which has cup-like protrusions and then adhering to it the legend sheet 12, which had been previously molded with matching cup-shaped indentations. The laminate is then cut by any conventional technique to form the individual keys 34.

While preferred embodiments have been shown and described, various modifications and substitutions may be made thereto without departing from the spirit and scope of the invention. Accordingly, it must be understood that the present invention has been described by way of illustration and not limitation.

What is claimed is:

1. A membrane type keyboard comprising:

switch array means, said switch array means including means defining a plurality of pairs of cooperating electrical contacts, the contacts of each pair being in registration and spatially separated to define normally open switches, at least a first of said contacts of each pair being supported on the first surface of a common flexible insulating substrate whereby the switches of said array means may be selectively closed by urging contact supporting portion of the flexible insulating substrate in the direction of cooperating contacts in registration therewith;

a layer of resilient foam material overlying and having a first surface bonded to with the second side of said flexible insulating substrate, said layer of resilient material having a second surface with a pattern of cuts or slits formed therein to define a plurality of key regions, the key regions being areas of the full thickness of said layer of foam material bounded and spaced from one another by areas of partial thickness of said resilient foam, said areas of partial thickness defining the periphery of key regions which are in registration with the pairs of cooperating contacts of said switch array means; and indicia providing means, said indicia providing means being adhered to the second surface of said layer of resilient material, said indicia providing means being sheet means having a pattern of cuts or slits commensurate, with the pattern of cuts or slits in said foam material, said indicia means forming labels for each of said key regions whereby the exertion of an actuating force having a component in a direction perpendicular to said second surface of said layer of resilient material will result in compression of said resilient material and the subsequent deformation of said flexible substrate to thereby close a switch of said array.

2. The keyboard of claim 1 wherein said layer of resilient material is comprised of a foam characterized by a low compression set.

3. The keyboard of claim 1 wherein said switch array means includes an apertured spacer sheet comprised of non-conductive material, apertures in said spacer sheet being aligned with the contacts of said pairs, said spacer sheet being in abutting contact with said first surface of said flexible substrate.

4. The keyboard of claim 3 wherein said switch array means further comprises backing means for providing a rigid support for the second contacts of each pair of contacts.

5. The keyboard of claim 4 wherein the exposed surfaces of said key regions are concave.

6. The keyboard of claim 5 wherein said key regions are of rectangular shape.

7. The membrane keyboard of claim 1 wherein:

said pattern of cuts or slits in said resilient foam material and said pattern of cuts or slits in said indicia means are formed simultaneously from continuous layer of said foam material and said indicia material to define a laminate structure having foam material key regions raised above a base area.

8. The membrane keyboard of claim 7 wherein:

said raised foam material key regions are exposed to and visible to the user of the keyboard.

9. The keyboard of claim 8 wherein said key regions are of rectangular shape.

10. The keyboards of claim 9 wherein said cuts or slits in said resilient material layer have a depth of between 0.1 and 0.5 inches.

11. The keyboard of claim 10 wherein the exposed surfaces of said rectangularly shaped key regions are concave.

12. The keyboard of claim 11 wherein said layer of resilient material is comprised of a foam characterized by a low compression set.

13. The keyboard of claim 9 wherein the exposed surfaces of said rectangularly shaped key regions are concave.

14. The keyboard of claim 13 wherein said layer of resilient material is comprised of a foam characterized by a low compression set.

15. The membrane keyboard of claim 1 wherein:

said pattern of cuts or slits in said foam layer defines a plurality of foam key regions raised above a base area, said raised keys being exposed to and visible to the user of the keyboard.

16. The membrane keyboard of claim 15 wherein:

said key regions rise from 0.100 to 0.500 inches above said base area to form a long travel membrane key structure.

17. A laminate structure for membrane keyboards, comprising:

a circuit sheet of flexible insulating material having electrically conductive elements on one surface thereof;

a layer of resilient foam material, a first surface of said layer of foam material being bonded to the second side of said circuit sheet, and a second surface of said layer of resilient foam having a pattern of cuts or slits formed therein to define a plurality of key regions, the key regions being areas of the full thickness of said layer of foam material bounded and spaced from one another by areas of partial thickness of said resilient foam; and indicia material means bonded to said second surface of said resilient foam, said indicia means also having a pattern of cuts or slits commensurate with the pattern of cuts or slits in said foam material.

18. A laminate structure for membrane keyboards as in claim 7 wherein:

said pattern of cuts or slits in said resilient foam material and said pattern of cuts or slits in said indicia means are formed simultaneously from continuous layers of said foam material and said indicia material to define a laminate structure having foam material key regions raised above a base area.

19. A laminate structure for membrane keyboards as in claim 18 wherein:

said raised foam material key regions are exposed to and visible to the user of the keyboard.

20. The laminate structure for membrane keyboards of claim 19 wherein said key regions are of rectangular shape.

21. The laminate structure for membrane keyboards of claim 20 wherein said cuts or slits in said resilient material layer have a depth of between 0.1 and 0.5 inches.

22. The laminate structure for membrane keyboards of claim 21 wherein the exposed surfaces of said rectangularly shaped key regions are concave.

23. The laminate structure for membrane keyboards of claim 22 wherein said layer of resilient material is comprised of a foam characterized by a low compression set.

24. The laminate structure for membrane keyboards of claim 20 wherein the exposed surfaces of said rectangularly shaped key regions are concave.

25. The laminate structure for membrane keyboards of claim 24 wherein said layer of resilient material is comprised of foam having a low compression set.

26. The laminate structure for membrane keyboards of claim 19 wherein said layer of resilient material is comprised of foam having a low compression set.

27. A laminate structure for membrane keyboards of claim 17 wherein:

said pattern of cuts or slits in said foam layer defines a plurality of foam key regions raised above a base area, said raised keys being exposed to and visible to the user of the keyboard.

28. A laminate structure for membrane keyboards of claim 27 wherein:

said key regions rise from 0.100 to 0.500 inches above said base area to form a long travel membrane key structure.

* * * * *